United States Patent [19]

Winter et al.

[11] Patent Number: 4,646,923

[45] Date of Patent: Mar. 3, 1987

[54] DISPLAY SYSTEM

[75] Inventors: Russell K. Winter, Crownsville; Thomas D. Harvey, Rockville; Nedim Savas, Bethesda, all of Md.

[73] Assignee: Russell William, Ltd., Odenton, Md.

[21] Appl. No.: 661,599

[22] Filed: Oct. 17, 1984

[51] Int. Cl.[4] ..... A47F 43/00

[52] U.S. Cl. ..... 211/189; 256/24

[58] Field of Search ..... 211/189, 71, 182, 183, 211/41; 256/DIG. 4, 24

[56] References Cited

U.S. PATENT DOCUMENTS

| | | | |
|---|---|---|---|
| 379,706 | 3/1888 | Landis | 256/21 X |
| 2,930,638 | 3/1960 | Morrissey | 211/182 X |
| 3,101,929 | 8/1963 | Dvore | 256/24 |
| 3,358,969 | 12/1967 | Blum et al. | 256/24 |
| 3,665,377 | 5/1972 | MacKenzie, Jr. | 211/150 X |
| 4,083,535 | 4/1978 | Britt | 256/24 |
| 4,282,977 | 8/1981 | Di Lorenzo | 211/189 X |
| 4,415,091 | 11/1983 | Wolff | 211/88 X |
| 4,508,231 | 4/1985 | Honickman | 211/189 X |

FOREIGN PATENT DOCUMENTS

| | | | |
|---|---|---|---|
| 1138600 | 6/1957 | France | 211/182 |

*Primary Examiner*—Ramon S. Britts
*Assistant Examiner*—Sarah A. Lechok Eley
*Attorney, Agent, or Firm*—Morton J. Rosenberg

[57] ABSTRACT

A display system (10) is provided for displaying articles mounted thereon. The display system (10) includes a plurality of panel members (18, 20 and 22) which are insertable into a frame mechanism (28) having vertical column members (36) and longitudinally extending row members (38). The frame mechanism (28) includes an open gridwork frame defined by column members (36) and row members (38). Additionally, said side panel members (46) are longitudinally displaced each from the other and releasably secured to frame body (30) to provide stability for display system (10) when such is mounted on a base surface (48). Article support mechanisms (58) are mounted on row members (38) for folding articles to be displayed thereon. The article support members (58) are removably secured to display system (10) in order that differing patterns may be changed and varied at the discretion of the user. Additionally, through the use of cooperating column members (36) and row members (38), article display may be attained on laterally opposing sides of display system (10) to maximize the display holding capabilities of display system (10).

23 Claims, 3 Drawing Figures

28
3
18
50
46
30
10
60
34
58
60
38
50
46
36
64
22
24
20
44
42
36
44
3
32
14
12
16

46
10
32
56
38
28
30
54
66
52
56
38
36
40
44
66
36
50
12
16

DISPLAY SYSTEM

BACKGROUND OF THE INVENTION

1. FIELD OF THE INVENTION

This invention directs itself to display systems for displaying articles mounted thereon. In particular, this invention directs itself to a modular and prefabricated type display system which includes the advantage of simplicity of construction and packaging for shipment. Still further, this invention directs itself to display systems which maximize viewing of articles contained thereon. More in particular, this invention pertains to display systems which include an open gridwork type construction allowing replaceability and changing of panel members therein. Further, this invention directs itself to display systems which allow for article support members to be mounted on all surfaces to increase the viewing capability of the articles being displayed.

2. PRIOR ART

Display systems are well known in the art. The best prior art known to the applicants include U.S. Pat. Nos.: 379,706; 4,231,552; 1,646,293; 375,292; 3,839,834; 3,648,981; 2,174,068; 4,094,085; and 3,961,456.

Some prior art such as that shown in U.S. Pat. No. 379,706 is directed to fence systems which allow for vertical members being sandwiched between horizontally directed and longitudinally extending row members. However, the vertical members are generally secured by other type fastenings to the horizontal members and there is no insert slot for changeability of panel members as is necessary to the subject invention concept.

In other prior art systems, such as U.S. Pat. No. 4,231,552, there are provided fence systems which include support members having channels formed therein. The channels in such prior art systems allow for vertical insert of panels and further allow for removal of such panels when it is desired. However, such prior art systems although providing for vertically removable panel members do not provide for an open gridwork type structure which provide for horizontally and longitudinally directed structural members for containing panels and for providing the structural integrity to mount articles thereon.

SUMMARY OF THE INVENTION

A display system for displaying articles mounted thereon is provided. The display system includes at least one panel member having a predetermined width with the panel member having opposing frontal and rear surfaces. The display system also includes a frame mechanism for (1) releasably capturing the panel member therein, and, (2) providing a stabilized mounting for the display system and the articles mounted thereon.

DESCRIPTION OF THE PREFERRED EMBODIMENTS

Figure 1:
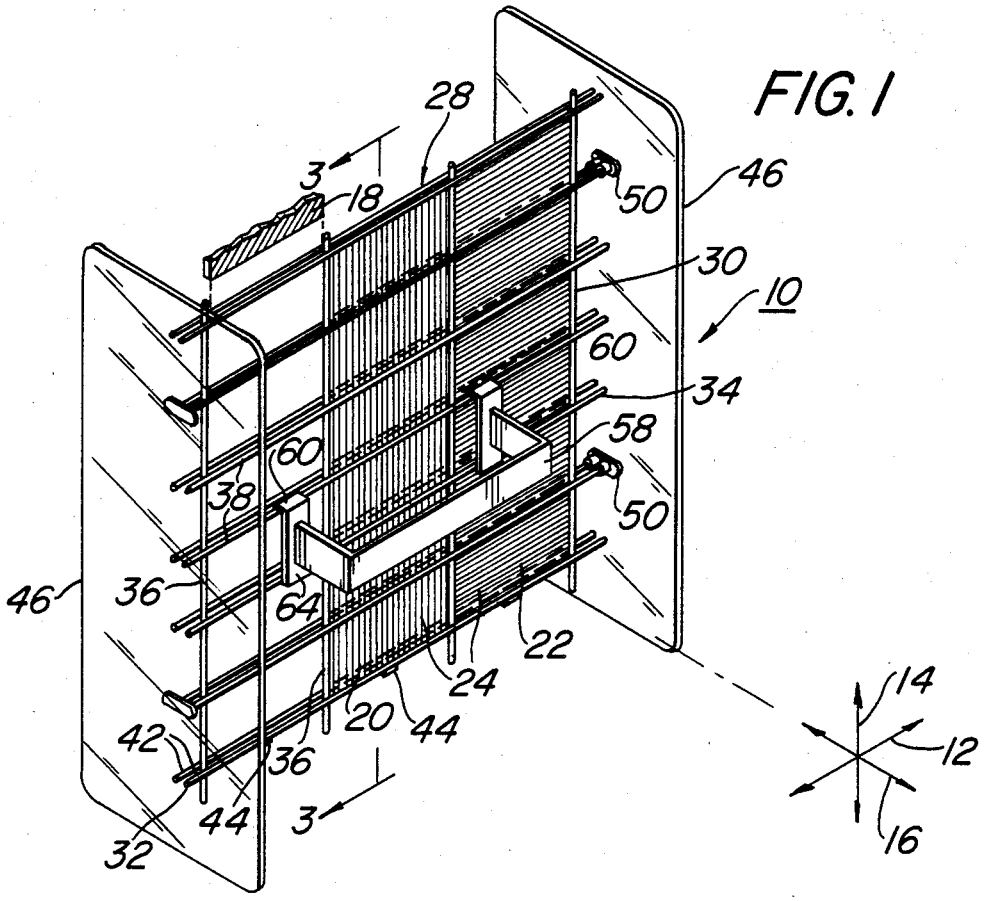
FIG. 1 is a perspective view of the display system.
Figure 2:
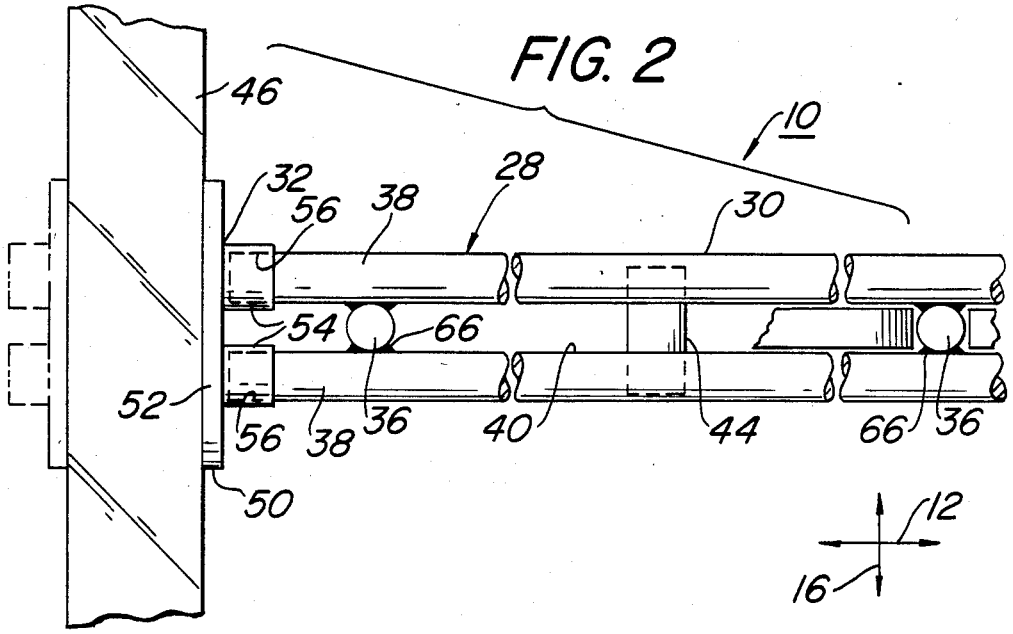
FIG. 2 is a cut-away plane view of the display system showing both column members and row members making up the frame body of the overall display system; and, FIG. 3 is a sectional view of the display system taken along the Section Line 3—3 of FIG. 1.
Figure 3:
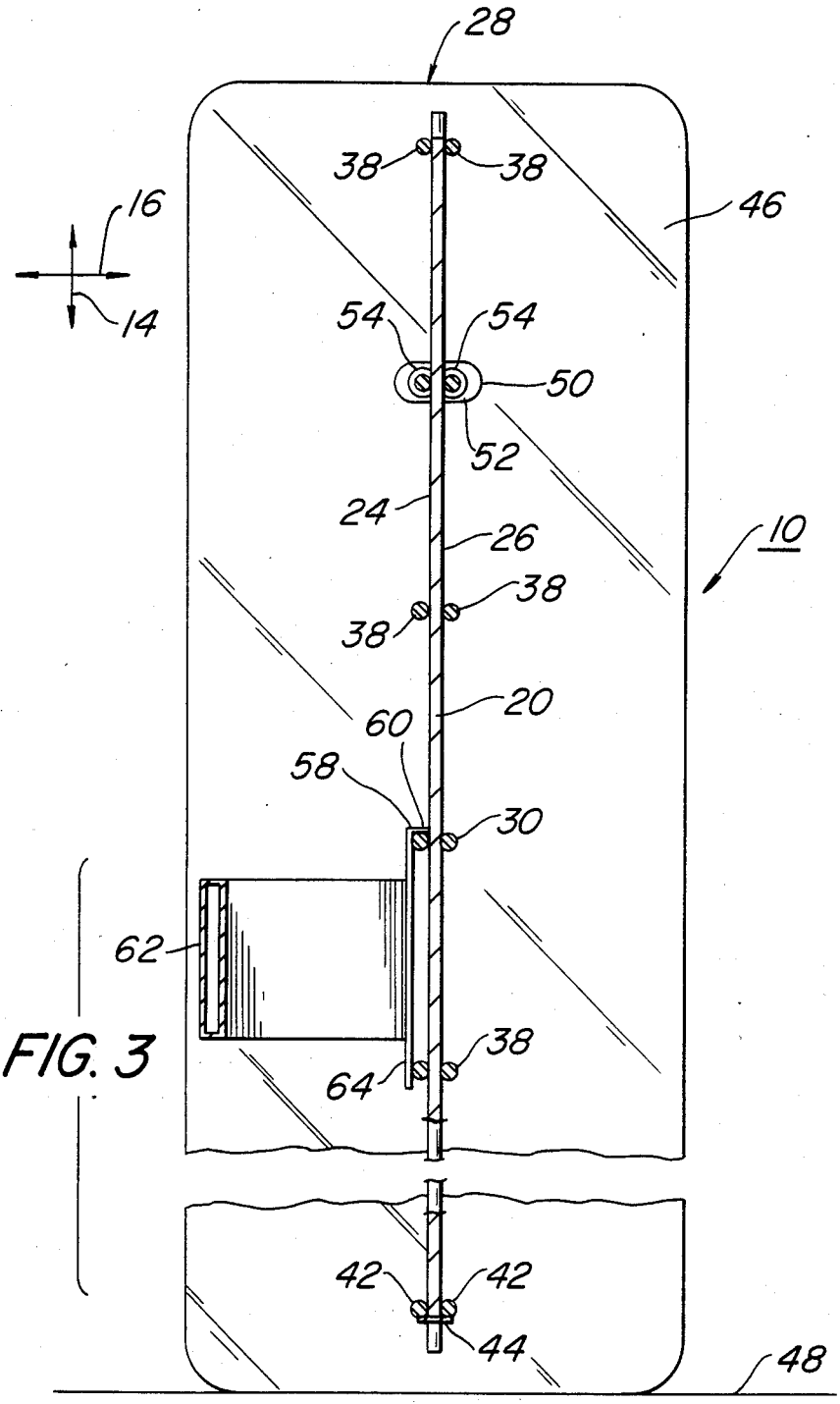

Referring now to FIGS. 1–3, there is shown shelf display system 10 for displaying articles mounted thereon. As will be seen in following paragraphs, display system 10 is specifically directed to the concept of providing an aesthetically pleasing display system 10 having the capability of changeability to provide a wide variety of visual designs and effects utilizing the same basic design structure. Although not restricted to commercial utilization, display system 10 is particularly adapted for use as a display-type system in commercial establishments where it is desired to constantly vary the display to the buying public, while simultaneously maintaining a low display cost. Additionally, display system 10 provides for a visually attractive system and allows for the system to act as a structural support for articles mounted thereon.

Display system 10 includes one or more panel members 18, 20, and 22, as is shown in FIGS. 1 and 3. FIG. 1 shows three panel members 18, 20 and 22, however, it is within the scope of the inventive concept that display system 10 may include a singular panel member or a multiplicity of panel members dependent upon the use being made and the size of the display system 10. Panel members 18, 20 and 22 include a predetermined width taken in a lateral direction 16, as defined by directional arrows shown in FIGS. 1 and 2.

Panel members 18, 20 and 22 include frontal surface 24 and rear surface 26 as is clearly shown in FIG. 3. Panel members 18, 20 and 22 are generally rectangular in contour and planar for purposes to be described in following paragraphs. Additionally, panel members 18, 20 and 22 may include a plurality of indicia and varying colors to provide pleasing effects. As can be seen in FIG. 1, panel members 18, 20 and 22 are removable from a mechanism 28 to allow changeability of panel members 18, 20 and 22 at the discretion of the user. Panel members 18, 20 and 22 are generally formed of a plastic-like composition which has the advantage of being lightweight and easily removable from display system 10 and with the added advantage that such panel members 18, 20 and 22 may easily be molded in different colors and provided with varying indicia. However, the particular composition of panel members 18, 20 and 22 is not important to the inventive concept as herein described, with the exception that such be applicable to display system 10 for simplified removal and insert therein.

Referring to FIGS. 1–3, frame mechanism 28 includes frame body 30 which extends in vertical direction 14 and longitudinal direction 12. Frame body 30 includes opposing longitudinal ends 32 and 34, as is shown in FIG. 1. Frame body 30 generally defines an open gridwork frame with panel members 18, 20 and 22, being releasably captured within the open gridwork frame and easily removable therefrom, as is shown in FIG. 1, wherein panel member 18 is seen being removed from frame body 30. Each of panel members 18, 20 and 22 may be slidingly inserted within frame body 30 and removable therefrom by displacement of panel members 18, 20 and 22, in vertical direction 14.

Frame body 30 defining the open gridwork frame includes at least a pair of vertically extending column members 36 which are displaced each from the other in longitudinal direction 12 by a dimension which is substantially equal to, but slightly greater than, a longitudinal dimension of a particular panel member 18, 20 or 22. In this way, as is shown in FIG. 1, panel member 18, 20 and 22 may be inserted between consecutively spaced column members 36. Additionally, frame body 30 further includes at least a pair of horizontally and longitudinally extending row members 38 which are fixedly secured to vertically extending column members 36. As can be seen in FIG. 2, vertically extending column members 36 are sandwiched between a particular pair of longitudinally extending row members 38 defining panel insert slots 40 for insert of panel members 18, 20 and 22 into frame body 30. In order to further permit insert of panel members 18, 20 and 22 into respective panel insert slots 40, horizontally and longitudinally extending row members 38 are displaced each from the other in lateral direction 16 by an amount substantially equal to but slightly greater than the width of panel members 18, 20, and 22 when taken in lateral direction 16.

As is seen in FIGS. 1 and 2, column members 36 may be rod members having a substantially circular contour in cross-section. In this case, column rod members 36 include a diameter which is substantially equal to but slightly greater than the width of panel members 18, 20, and 22 when taken in lateral direction 16. It is to be understood that vertically extending column members 36 may be provided with a multiplicity of contours such as square, rectangular, or other type contour not important to the inventive concept as herein described with the exception that the dimension in lateral direction 16 be of sufficient length so as to allow insert of panel members 18, 20, and 22 within respective panel insert slots 40. Similarly, horizontally and longitudinally extending row members 38 may take the contour of circular members or other type contour as has been previously described for column members 36.

As is seen in FIGS. 1 and 3, frame body 30 further includes lower pair of horizontally and longitudinally extending row members 42 extending in longitudinal direction 12. Tab members 44 are fixedly secured to the lower pair of row members 42. Tab members 44 extend in a lateral or transverse direction 16. Tab members 44 intersect panel insert slot 40 in order to form a base or support for an associated panel member 18, 20, or 22 between respective and consecutivelyspaced column members 36. In this manner, panel members 18, 20, and 22 may be inserted into a respective panel insert slot 40 and will then be supported at a lower point or lower section of frame body 30. In this manner, each of panel members 18, 20, and 22 are supported by frame body 30 when taken with respect to vertical direction 14.

Frame mechanism 28 of display system 10 further includes side panel members 46 each of which are coupled to respective end sections 32 and 34 of frame body 30. As can be seen in FIG. 1, side panel members 46 are longitudinally displaced each with respect to the other. Side panel members 46 extend in a vertical direction 14 substantially throughout the vertical extension of frame body 30. Additionally, and of importance to stability, side panel members 46 extend in lateral or transverse direction 16 substantially normal longitudinal direction 12. Side panel members 46 are in contiguous contact with base surface 48 to provide a stable platform for display system 10.

Side panel members 46 may be generally rectangular in contour and as is shown, may be substantially planar. Additionally, side panel members 46 may be formed of a material composition which is substantially transparent or translucent. In this manner, articles contained and mounted on display system 10 may be viewed from a plurality of visual angles and give a maximization of visuality to articles contained or mounted on display system 10. Side panel members 46 may be formed of a plastic-like composition or other type material not important to the inventive concept herein described.

Thus, as has been previously described, display system 10 is provided for mounting articles to be displayed thereon. Display system 10 includes panel members 18, 20, or 22 having a predetermined width in lateral or transverse direction 16. Further, display system 10 includes frame mechanism 28 which releasably captures panel members 18, 20, and 22 therein and further provides a stabilized mounting for display system 10 on base surface 48 for the articles mounted thereon.

Display system 10 further includes bracket members 50 secured to side panel members 46. Bracket members 50 are releasably coupled to respective horizontally and longitudinally extending row members 38 for purposes of supporting row members 38 on display system 10. Bracket members 50 may be fixedly secured to side panel members 46 by threaded securement, adhesive mechanism, bonding or some like technique not important to the inventive concept as herein described.

Bracket members 50 include bracket member base sections 52, which are generally planar in contour and contiguously interfaced with a planar surface of one of side panel members 46. Additionally, bracket members 50 include a pair of boss members 54 extending in longitudinal direction 12 as is clearly seen in FIG. 2. Boss members 54 are displaced each from the other in a lateral or transverse direction 16 and are secured to bracket member base section 52, either in one piece formation or through fixed coupling such as bolting, bonding, adhesive securement or some like technique. Further, boss members 54 include boss insert openings 56 which define boss bores having a diameter or a contour substantially identical to horizontal and longitudinally extending row members 38 for insert of row members 38 within boss insert openings 56. Bracket members 50 provide for additional structural support functions associated with display system 10 to allow greater force loads to be applied to display system 10 dependent upon the articles mounted thereon for display purposes. Additionally, as is shown in FIG. 2, further bracket members 50 may be mounted on opposing faces or surfaces of side panel members 46 dependent upon whether in reality side panel members 46 are end members of display system 10 or in the alternative side panel members 46 may be intermediate panel members for a continuation of display system 10 in a longitudinal direction 12.

One of the very important concepts of display system 10 is that through the unique configuration and combination of elements, articles may be mounted on opposing transverse sides of panel members 18, 20, and 22 when taken in direction 16. Further, horizontally and longitudinally extending row members 38 may be used as a support for articles contained or mounted on display system 10. Additionally, as will be seen in the following paragraphs, the sandwiching of vertically extending column members 36 between opposing laterally displaced row members 38 allow for row members 38 to provide for a support of articles contained on display system 10 on opposing faces of panel members 18, 20, and 22.

As is shown in FIGS. 1 and 3, display system 10 further includes article support member 58 which is releasably secured to at least one of horizontally and longitudinally extending row members 38 for supporting articles to be displayed thereon.

Article support member 58, as is shown in FIG. 1, may include a pair of hook members 60 which are longitudinally displaced each from the other. Additionally, support bar member 62 is secured to hook members 60 either in one-piece formation, or through welding, adhesive bonding, or some like technique. Support bar member 62 extends in longitudinal direction 12 between hook members 60 and provide for a unitary and fixed article support mechanism 58. Support bar 62 is generally U-shaped in contour in order to provide a displacement from panel members 18, 20 and 22, in order that some type of article may be hung thereon. Hook members 60 further include vertically directed portions or sections 64 having a vertical extension in vertical direction 14 greater than a vertical displacement between consecutively displaced row members 38 in vertical direction 14. As can be seen from FIG. 3, the vertical extension of vertically directed portion 64 allows for bearing structural loads from articles mounted on support bar member 62 to be transferred and divided between consecutively vertically displaced row members 38. In this manner, the structural integrity of display system 10 is enhanced.

In order to increase structural integrity of display system 10, vertically extending column members 36 are fixedly secured to horizontally directed and longitudinally extending row members 38. Fixed securement may be through weld points 66, as is seen in FIG. 2. Thus, frame body 30 is formed into a singular rigid structure adaptable to maintain a structural integrity when articles are mounted on display system 10. Additionally, frame body 30 as is seen in FIGS. 1–3, may provide a substantially planar envelope contour.

Additionally, there has been shown display system 10 which is generally formed by planar members such as panel members 18, 20 and 22, as well as a generally planar frame body 30 and planar side panels 46. Side panel members 46 may be removable from frame body 30 of frame mechanism 28 into a economically designed shipping pacakge. Display system 10 may be constructed on-site in a simple method by insert of panel members 18, 20, and 22 into respective panel insert slots 40. Frame body 30 may then be placed in a vertical position coincident with a plane defined by longitudinal direction 12 and vertical direction 14 for insert into side panel members 46, possibly using bracket members 50. In this manner, there is provided a modular-type display system 10 which is pre-fabricated and may be varied on-site in a simple manner by the user through insert of differing panels 18, 20, and 22 which only have to be slideably inserted within respective panel inserts slots 40.

Although this invention has beed desribed in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A display system for displaying articles mounted thereon comprising:

(a) at least one panel member having a predetermined width, said panel member having opposing frontal and rear surfaces;

(b) frame means for (1) releasably capturing said panel member therein and, (2) providing a stabilized mounting for said display system and said articles mounted thereon, said frame means including a frame body extending in a vertical direction and a longitudinal direction having opposing longitudinal ends and at least a pair of side panel members coupled to said opposing longitudinal ends of said frame body, each of said side panel members extending in said vertical direction and a lateral direction substantially normal said longitudinal direction and extending laterally beyond said frame body for providing a stabilizing interfacce with a base surface; and, (c) at least a pair of bracket members secured to each of said side panels members, said bracket members being releasably coupled to said frame body, said frame body including at least a pair of vertically extending column members longitudinally displaced each from the other by a dimension substantially equal to a longitudinal dimension of said panel member and at least a pair of horizontally and longitudinally extending row members fixedly secured to said vertically extending column members, said column members being sandwiched between said pair of row members for providing an insert guideway for insert of said panel member.

2. The display system as recited in claim 1 where said frame body includes an open gridwork frame, said panel member being captured within said open gridwork frame and removable therefrom.

3. The display system as recited in claim 1 where said pair of horizontally and longitudinally extending row members are displaced each from the other by an amount substantially equal to said width of said panel member.

4. The display system as recited in claim 1 where said pair of column members and said row members define an open slot, said panel member being slidably insertable in said open slot in said vertical direction.

5. The display system as recited in claim 1 where said pair of vertically extending column members are rod members having a substantially circular contour in cross-section, said rod members having a diameter substantially equal to said width of said panel member.

6. The display system as recited in claim 1 where said frame body includes a lower pair of horizontally and longitudinally extending row members having at least one tab member passing in said transverse direction and fixedly secured to said lower pair of row members for supporting said panel member in said vertical direction.

7. The display system as recited in claim 1 where said side panel is formed of a material composition which is substantially transparent.

8. The display system as recited in claim 7 where said side panels are formed of a plastic composition material.

9. The display system as recited in claim 1 where said bracket member includes a base section secured to said side panel and a pair of bosses having insert openings in registration with said pair of row members for insert of said row member within said insert openings.

10. The display system as recited in claim 1 including article support means releasably secured to at least one of said horizontally and longitudinally extending row members for supporting articles to be displayed thereon.

11. The display system as recited in claim 10 where said article support means includes:

(a) a pair of hook members longitudinally displaced each from the other; and, (b) a support bar member secured to said pair of hook members, said support bar members extending in said horizontal and longitudinal directions between said hook members.

12. The display system as recited in claim 11 where said pair of hook members include a vertically directed portion having a vertical extension greater than a vertical displacement between vertically consecutively displaced row members.

13. The display system as recited in claim 1 including a plurality of panel members insertable within said frame means, said panel members having differing indicia formed thereon to provide varying visual effects.

14. The display system as recited in claim 1 where said column members are fixedly secured to a respective pair of row members.

15. The display system as recited in claim 15 where said column members are welded to said respective pair of row members.

16. The display system as recited in claim 1 where said frame body includes a substantially planar envelope contour.

17. The display system as recited in claim 1 where said side panel member is substantially planar in contour, said side panel member being substantially transparent.

18. A display system for displaying articles mounted thereon, comprising:

(a) at least one panel member having a longitudinal dimension and a predetermined width in a lateral direction normal said longitudinal dimension direction;

(b) at least two vertically directed rod members longitudinally displaced each from the other by said predetermined longitudinal dimension of said panel member;

(c) at least two pairs of longitudinally directed rod members, said pair of longitudinally directed rod members being vertically displaced each from the other, said vertically directed rod members being sandwiched between said longitudinally directed rod members and secured thereto for defining a slot for releasable insert of said panel member between a pair of said vertically directed rod members and said two pairs of said longitudinally directed rod members; and, (d) a pair of side panel members extending in said lateral direction, said panel members being releasably secured to at least one pair of said longitudinally directed rod members and having a lateral dimension greater than a lateral dimension of said pairs of said longitudinally directed rod members.

19. The display system as recited in claim 18 including means for releasably securing said longitudinally directed rod members to said side panel members, said releasable securement being secured to said opposing side panel members for coupling to opposing longitudinal ends of said longitudinally directed rod members.

20. The display system as recited in claim 19 where said releasable securement means includes at least a pair of bracket members fixedly secured to said side panel members, said longitudinally directed rod members being slidably inserted within said bracket members.

21. The display system as recited in claim 18 including article support means releasably secured to at least one of said longitudinally directed rod members of one of said pairs of said longitudinally directed rod members and extending vertically by a dimension greater than said vertical displacement between said pairs of longitudinally directed rod members.

22. The display system as recited in claim 21 where said article support means includes:

(a) a pair of hook members longitudinally displaced each from the other; and, (b) a support bar member secured to said pair of hooks members, said support bar members extending in said horizontal and longitudinal directions between said hook members.

23. The display system as recited in claim 18 where said side panel members are substantially transparent.

* * * * *